US011302183B2

(12) United States Patent
Honda

(10) Patent No.: US 11,302,183 B2
(45) Date of Patent: Apr. 12, 2022

(54) VEHICLE INFORMATION ACQUISITION APPARATUS, VEHICLE INFORMATION ACQUISITION SYSTEM, VEHICLE INFORMATION ACQUISITION METHOD, AND VEHICLE INFORMATION ACQUISITION PROGRAM

(71) Applicant: TOYOTA JIDOSHA KABUSHIKI KAISHA, Toyota (JP)

(72) Inventor: Daisaku Honda, Kasugai (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/100,288

(22) Filed: Nov. 20, 2020

(65) Prior Publication Data

US 2021/0201671 A1 Jul. 1, 2021

(30) Foreign Application Priority Data

Dec. 27, 2019 (JP) ..... JP2019-237917
Jul. 28, 2020 (JP) ..... JP2020-127650

(51) Int. Cl.
*G08G 1/065* (2006.01)
*G08G 1/017* (2006.01)

(52) U.S. Cl.
CPC ..... *G08G 1/065* (2013.01); *G08G 1/017* (2013.01)

(58) Field of Classification Search
CPC ..... G08G 1/065; G08G 1/017
See application file for complete search history.

(56) References Cited

U.S. PATENT DOCUMENTS 10,689,815 B2 * 6/2020 Sheckler ..... G08G 1/0104
2012/0004835 A1 * 1/2012 Sato ..... G08G 1/0104 701/118
2013/0211624 A1 * 8/2013 Lind ..... G08G 1/22 701/2
2014/0292545 A1 * 10/2014 Nemoto ..... G08G 1/163 340/988
2019/0272756 A1 * 9/2019 Naito ..... G08G 1/091

FOREIGN PATENT DOCUMENTS

JP 2012-237762 A 12/2012
JP 2012237762 A * 12/2012
JP 2014-191492 A 10/2014
JP 2015-097038 A 5/2015

* cited by examiner

*Primary Examiner* — Mohamed Barakat
(74) *Attorney, Agent, or Firm* — Oliff PLC

(57) ABSTRACT

A vehicle information acquisition apparatus which enables a vehicle on which a predetermined on-board device is mounted to acquire information including a vehicle on which this on-board device is not mounted. A vehicle information acquisition apparatus according to an aspect of the present disclosure includes a vehicle authentication unit configured to execute vehicle authentication on a vehicle entering a preset range based on preset vehicle authentication information, and an integration unit configured to integrate the number of vehicles passing after the vehicle passes when the vehicle authentication executed on the vehicle is successful. The vehicle information acquisition apparatus is configured to notify, when the vehicle authentication executed on another vehicle passing after the vehicle passes is successful, the other vehicle of the number of vehicles integrated by the integration unit.

10 Claims, 7 Drawing Sheets

VEHICLE INFORMATION ACQUISITION APPARATUS, VEHICLE INFORMATION ACQUISITION SYSTEM, VEHICLE INFORMATION ACQUISITION METHOD, AND VEHICLE INFORMATION ACQUISITION PROGRAM

CROSS REFERENCE TO RELATED APPLICATIONS

This application is based upon and claims the benefit of priority from Japanese patent applications No. 2019-237917, filed on Dec. 27, 2019, and No. 2020-127650, filed on Jul. 28, 2020, the disclosure of which is incorporated herein in its entirety by reference.

BACKGROUND

The present disclosure relates to a vehicle information acquisition apparatus, a vehicle information acquisition system, a vehicle information acquisition method, and a vehicle information acquisition program.

A so-called traffic counter is configured to count the number of vehicles while determining types of the vehicles traveling under a sensor of the traffic counter. The traffic counter can acquire information about the types of the vehicles and the number of traveling vehicles. On the other hand, as disclosed in Japanese Unexamined Patent Application Publication No. 2014-191492, a technique for obtaining probe information such as a traveling position, a traveling time, and a traveling speed of a vehicle using a vehicle on which a predetermined on-board device is mounted as a probe has been put into practical use.

SUMMARY

Applicants have found the following problems. The technique disclosed in Japanese Unexamined Patent Application Publication No. 2014-191492 is not configured such that a vehicle on which a predetermined on-board device is mounted can acquire information about a vehicle on which this on-board device is not mounted. Thus, for example, a vehicle of Company A cannot acquire information including the vehicles of Company B or Company C.

The present disclosure has been made in view of such a problem and achieves a vehicle information acquisition apparatus, a vehicle information acquisition system, a vehicle information acquisition method, and a vehicle information acquisition program, which enable a vehicle on which a predetermined on-board device is mounted to acquire information including a vehicle on which this on-board device is not mounted.

An example aspect of the present disclosure is a vehicle information acquisition apparatus including:

a vehicle authentication unit configured to execute vehicle authentication on a vehicle entering a preset range based on preset vehicle authentication information; and an integration unit configured to integrate the number of vehicles passing after the vehicle passes when the vehicle authentication executed on the vehicle is successful.

The vehicle information acquisition apparatus configured to notify, when the vehicle authentication executed on another vehicle passing after the vehicle passes is successful, the other vehicle of the number of vehicles integrated by the integration unit.

The above vehicle information acquisition apparatus may further include:

a vehicle recognition unit configured to acquire an image of the vehicle entering the preset range, and recognize the vehicle entering the preset range based on the acquired image.

The integration unit may includes:

vehicle number integration means for integrating the number of vehicles entering the preset range based on a result of the recognition of the vehicle; and reset means for instructing the vehicle number integration means to reset the integration of the number of vehicles when the vehicle authentication on the other vehicle is successful.

In the above vehicle information acquisition apparatus, the vehicle authentication unit may include:

vehicle registration means for setting the preset vehicle authentication information; and vehicle authentication means for executing the vehicle authentication on the vehicle entering the preset range based on the preset vehicle authentication information.

Another example aspect of the present disclosure is a vehicle information acquisition system including:

the above vehicle information acquisition apparatus; and a database configured to be notified of, when the vehicle notified of the number of vehicles integrated by the integration unit from the vehicle information acquisition apparatus enters a communicable range, the number of vehicles integrated by the integration unit from the vehicle.

In the above vehicle information acquisition system, a plurality of the vehicle information acquisition apparatuses may be installed in a mutually communicable manner.

Another example aspect of the present disclosure is a vehicle information acquisition method including:

executing vehicle authentication on a vehicle entering a preset range based on preset vehicle authentication information;

integrating the number of vehicles passing after the vehicle passes when the vehicle authentication executed on the vehicle is successful; and notifying, when the vehicle authentication executed on another vehicle passing after the vehicle passes is successful, the other vehicle of the integrated number of vehicles.

The above vehicle information acquisition method may further include:

acquiring an image of the vehicle entering the preset range, and recognizing the vehicle entering the preset range based on the acquired image;

notifying the other vehicle which is successfully authenticated of a result of the recognition of the vehicle entering the preset range while the number of vehicles is integarated.

The above vehicle information acquisition method may further include:

acquiring the image of the vehicle entering the preset range, and acquiring a passage time or a traveling speed of the vehicle based on the acquired image; and notifying the other vehicle which is successfully authenticated of the passage time or the traveling speed of the vehicle entering the preset range while the number of vehicles is integrated.

The above vehicle information acquisition method may further include:

acquiring an authentication time at which the vehicle authentication is executed on the vehicle entering the preset range; and notifying the other vehicle which is successfully authenticated of the authentication time of the vehicle entering the preset range while the number of vehicles is integrated.

Another example aspect of the present disclosure is a vehicle information acquisition program for causing a computer to execute:

a process of executing vehicle authentication on a vehicle entering a preset range based on preset vehicle authentication information;

a process of integrating the number of vehicles passing after the vehicle passes when the vehicle authentication executed on the vehicle is successful; and a process of notifying, when the vehicle authentication executed on another vehicle passing after the vehicle passes is successful, the other vehicle of the integrated number of vehicles.

According to the present disclosure, it is possible to achieve a vehicle information acquisition apparatus, a vehicle information acquisition system, a vehicle information acquisition method, and a vehicle information acquisition program, which enable a vehicle on which a predetermined on-board device is mounted to acquire information including a vehicle on which this on-board device is not mounted.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Hereinafter, a specific embodiment to which the present disclosure is applied will be described in detail with reference to the drawings. However, the present disclosure is not limited to the following embodiment. In order to clarify the description, the following description and drawings are appropriately simplified.

Figure 1:
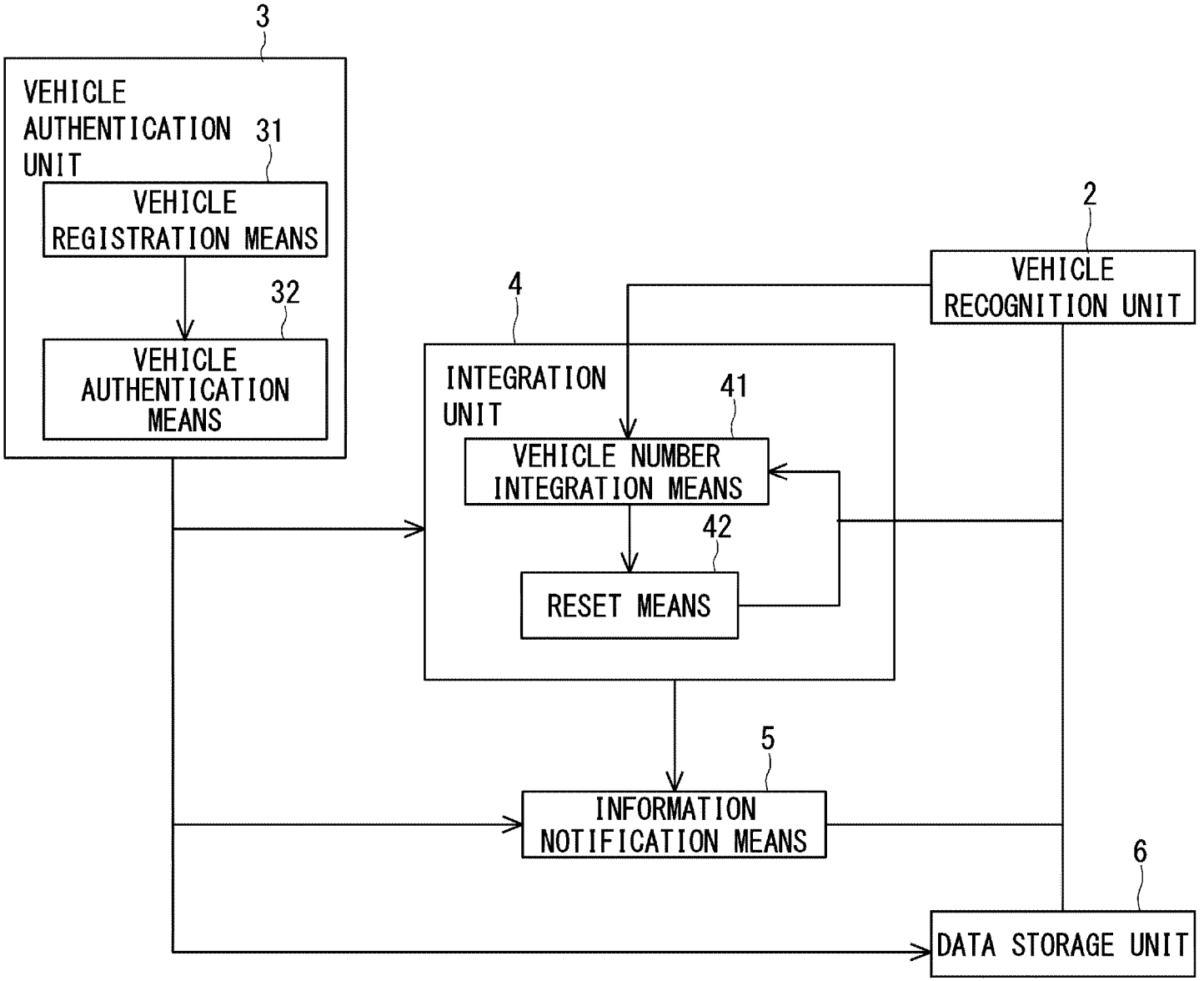
FIG. 1 is a block diagram showing a configuration of a vehicle information acquisition apparatus according to an embodiment of the present disclosure.

A configuration of a vehicle information acquisition apparatus according to this embodiment will be described. FIG. 1 is a block diagram showing the configuration of the vehicle information acquisition apparatus according to this embodiment. The vehicle information acquisition apparatus 1 includes, for example, a vehicle recognition unit 2, a vehicle authentication unit 3, an integration unit 4, an information notification unit 5, and a data storage unit 6.

The vehicle recognition unit 2 recognizes a type of a vehicle (large vehicle, medium vehicle, small vehicle, two-wheeled vehicle, etc.) based on, for example, a change in a current flowing through a coil buried in a road, a reflection of an ultrasonic pulse of an ultrasonic sensor installed on the road, or an image acquired by a CCTV (Closed Circuit Television) installed on the road, and then outputs a recognition result of the vehicle to the integration unit 4. However, the vehicle recognition unit 2 may be configured to recognize at least that the vehicle has passed.

At this time, the vehicle recognition unit 2 may output a passage time of each vehicle to the data storage unit 6. The vehicle recognition unit 2 may calculate a traveling speed of the vehicle based on, for example, the acquired image, and then output the traveling speed of the vehicle to the data storage unit 6.

The vehicle authentication unit 3 executes vehicle authentication on a vehicle entering a preset range (i.e., a range within which communication with the vehicle is possible) based on preset vehicle authentication information. The vehicle authentication unit 3 includes, for example, vehicle registration means 31 and vehicle authentication means 32. The vehicle registration means 31 sets vehicle authentication information for enabling communication with a desired vehicle, which will be described in detail later.

The vehicle authentication means 32 executes the vehicle authentication on the vehicle entering the preset range based on the vehicle authentication information set by the vehicle registration means 31, and outputs the authentication result to the integration unit 4 and the information notification unit 5. At this time, the vehicle authentication unit 32 may output an authentication time together with the authentication result to the data storage unit 6.

The integration unit 4 includes vehicle number integration means 41 and reset means 42. The vehicle number integration means 41 integrates the number of traveling vehicles based on the recognition result of the vehicles input from the vehicle recognition unit 2. The vehicle number integration means 41 outputs the integration result together with the recognition result of the vehicles to the reset means 42.

When the authentication result input from the vehicle authentication means 32 satisfies a preset condition, the reset means 42 instructs the vehicle number integration means 41 to reset the integration of the number of traveling vehicles, and outputs the integration result together with the recognition result of the vehicles to the information notification unit 5 and the data storage unit 6.

The information notification unit 5 outputs the recognition result and the integration result of the vehicles input from the reset means 42 as vehicle information to the vehicle which has been successfully authenticated based on the authentication result input from the vehicle authentication means 32. The data storage unit 6 stores the recognition result, the integration result, and the like of the vehicles input from the reset means 42.

Figure 2A:
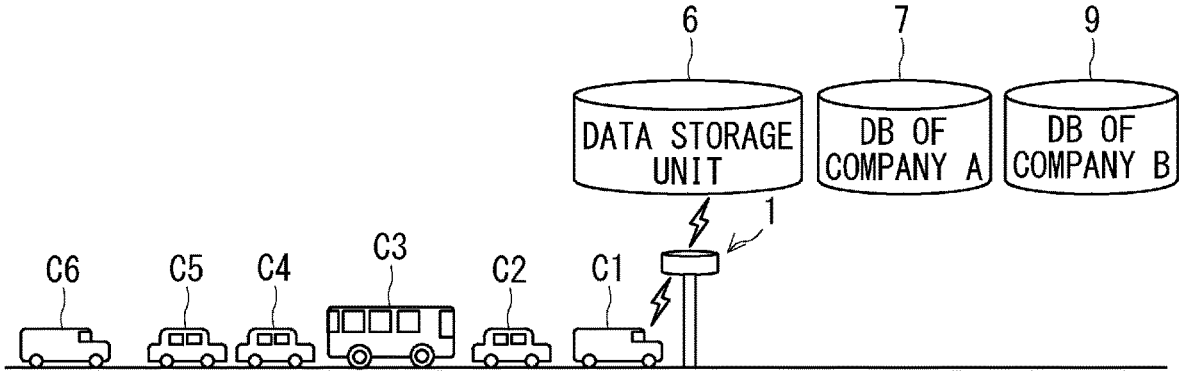
FIG. 2A shows a state in which vehicle information acquired by the vehicle information acquisition apparatus according to the embodiment is output to a database via a vehicle.

Next, a flow of outputting the vehicle information acquired by the vehicle information acquisition apparatus 1 according to this embodiment to a database of Company A and a database of Company B will be described. FIGS. 2A to 2D show a state in which the vehicle information acquired by the vehicle information acquisition apparatus according to this embodiment is output to the databases via the vehicle. FIG. 3 is a sequence diagram showing communication between the vehicle information acquisition apparatus according to this embodiment and a vehicle system of Company A.

The vehicle information acquisition apparatus 1 according to this embodiment acquires, as the vehicle information desired by Company A, the number of vehicles from the time when the vehicle on which an on-board device of Company A is mounted has passed to the time when the next vehicle on which the on-board device of Company A is mounted has passed on an unbranched road, and the recognition result of the vehicles that have passed while the number of vehicles is integrated. The vehicle information acquisition apparatus 1 according to this embodiment further acquires, as the vehicle information desired by Company B, the number of vehicles from the time when the vehicle on which an on-board device of Company B is mounted has passed to the time when the next vehicle on which the on-board device of Company B is mounted has passed on an unbranched road, and the recognition result of the vehicles that have passed while the number of vehicles is integrated.

Therefore, the vehicle registration means 31 sets the vehicle authentication information for achieving the vehicle authentication separately for the vehicle on which the on-board device of Company A is mounted and the vehicle on which the on-board device of Company B is mounted. In FIGS. 2A to 2D, vehicles C1 and C6 are vehicles on which the on-board device of Company A is mounted, vehicles C2 and C5 are vehicles on which the on-board device of Company B is mounted, and vehicles C3 and C4 are vehicles on which no on-board device is mounted.

Further, as the abovementioned preset condition, the reset means 42 is configured to instruct the vehicle number integration means 41 to reset the number of vehicles in the vehicle information desired by Company A when the next vehicle on which the on-board device of Company A is mounted has passed, and to instruct the vehicle number integration means 41 to reset the number of vehicles in the vehicle information desired by Company B when the next vehicle on which the on-board device of Company B is mounted has passed.

The vehicle recognition unit 2 outputs the recognition result of the passing vehicles to the integration unit 4. Then, as shown in FIGS. 2A and 3, the vehicle authentication unit 3 executes the vehicle authentication on the vehicle C1 entering the preset range based on the vehicle authentication information set by the vehicle registration means 31.

Since the on-board device of Company A is mounted on the vehicle C1, the vehicle C1 responds to a request for the vehicle authentication from the vehicle authentication unit 3 of the vehicle information acquisition apparatus 1. Then, the vehicle authentication unit 3 which has received the response from the vehicle C1 recognizes that the vehicle authentication has been successful and outputs the authentication result to the integration unit 4 and the information notification unit 5.

When the authentication result is input to the integration unit 4, the vehicle number integration means 41 outputs, to the reset means 42, the integration result of the number of vehicles from the last time when the vehicle on which the on-board device of Company A is mounted has passed to the time when the vehicle C1 has passed, and the recognition result of the vehicle C1 input from the vehicle recognition unit 2.

The reset means 42 outputs the integration result of the number of vehicles from the last time when the vehicle on which the on-board device of Company A is mounted has passed to the time when the vehicle C1 has passed, and the recognition result of the vehicles input from the vehicle recognition unit 2 while the number of vehicles is integrated, to the vehicle C1 via the information notification unit 5, and instructs the vehicle number integration means 41 to reset the integration result of the number of vehicles in the vehicle information desired by Company A.

When the vehicle C1 enters the range where the vehicle C1 can communicate with a database (DB) 7 of Company A, the vehicle C1 outputs, to the DB 7 of Company A, the integration result of the number of vehicles acquired from the vehicle information acquisition apparatus 1 from the last time when the vehicle on which the on-board device of Company A is mounted has passed to the time when the vehicle C1 has passed, and the recognition result of the vehicles input from the vehicle recognition unit 2 while the number of vehicles is integrated.

That is, as shown in FIG. 3, the vehicle on which the on-board device of Company A is mounted and the DB 7 of Company A constitute a vehicle system 8 of Company A. The vehicle information acquisition apparatus 1 and the DB 7 of Company A constitute a vehicle information acquisition system.

At this time, when the authentication time, the passage time, or the traveling speed of each vehicle is stored in the data storage unit 6 from the time when the vehicle on which the on-board device of Company A is mounted passes to the time when the vehicle C1 passes (i.e., until the vehicle C1 enters the preset range while the integration unit 4 is integrating the number of vehicles), the vehicle information acquisition apparatus 1 may output the authentication time, the passage time, or the traveling speed of each vehicle to the vehicle C1 via the information notification unit 5, and further output the authentication time, the passage time, or the traveling speed of each vehicle to the DB 7 of Company A via the vehicle C1.

The vehicle number integration means 41 starts integrating the number of vehicles in the vehicle information desired by Company A after the reset based on the recognition result of the vehicles input from the vehicle recognition unit 2, and continues to integrate the number of vehicles in the vehicle information desired by Company B. At this time, the reset means 42 acquires the recognition result of the vehicles from the last time when the vehicle on which the on-board device of Company B is mounted has passed to the time when the vehicle C1 has passed.

Figure 2B:
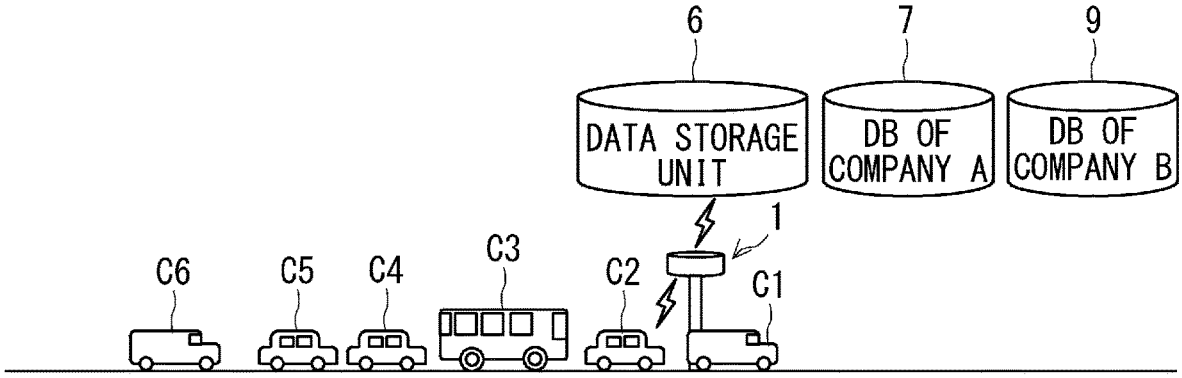
FIG. 2B shows a state in which vehicle information acquired by the vehicle information acquisition apparatus according to the embodiment is output to a database via a vehicle.
Figure 3:
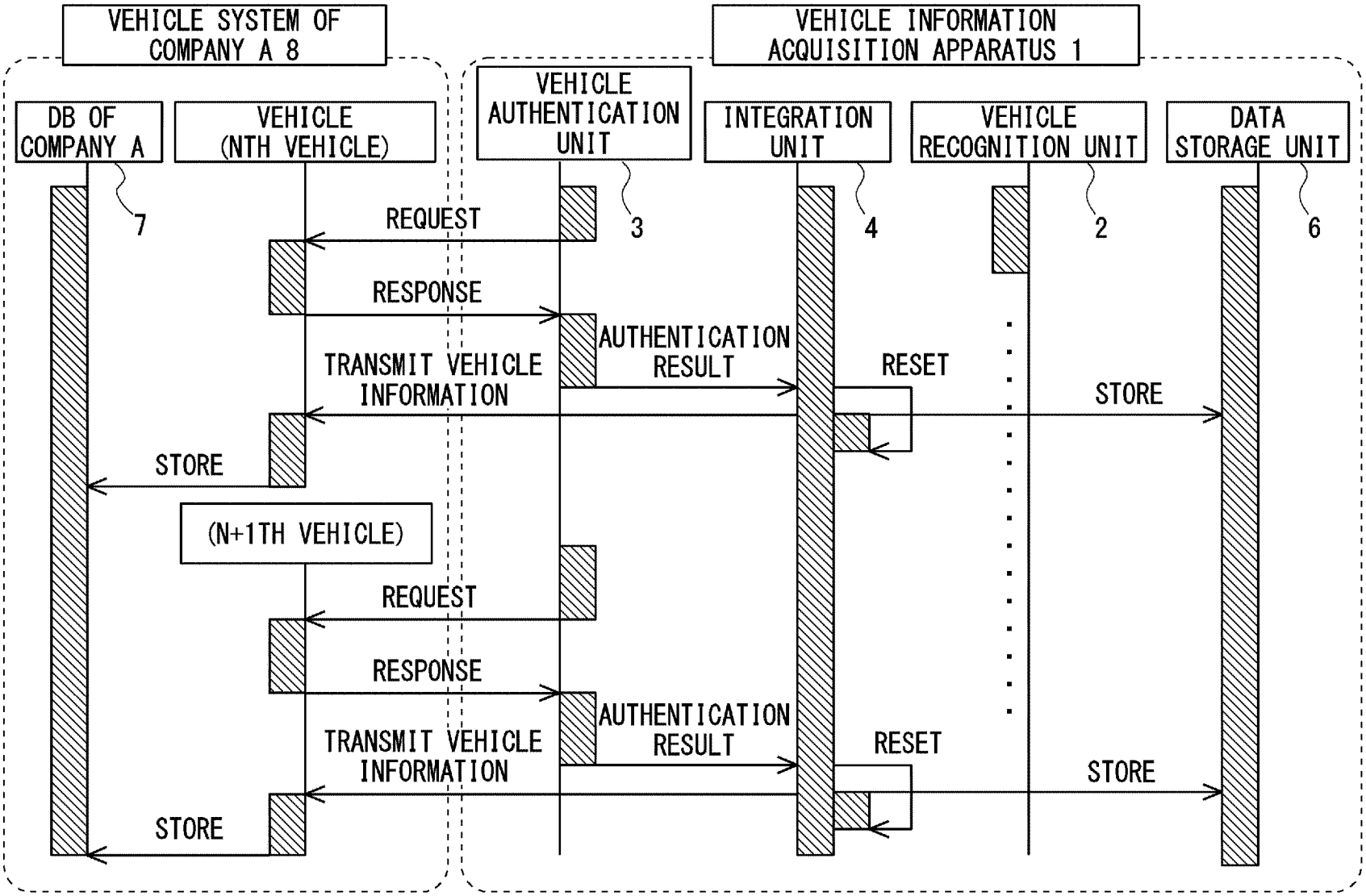
FIG. 3 is a sequence diagram showing communication between the vehicle information acquisition apparatus and a vehicle system of Company A according to the embodiment.

Next, as shown in FIG. 2B, the vehicle authentication unit 3 executes the vehicle authentication on the vehicle C2 entering the preset range based on the vehicle authentication information set by the vehicle registration means 31.

Since the on-board device of Company B is mounted on the vehicle C2, the vehicle C2 responds to a request for vehicle authentication from the vehicle authentication unit 3 of the vehicle information acquisition apparatus 1. Then, the vehicle authentication unit 3 which has received the response from the vehicle C2 recognizes that the vehicle authentication has been successful and outputs the authentication result to the integration unit 4 and the information notification unit 5.

When the authentication result is input to the integration unit 4, the vehicle number integration means 41 outputs, to the reset means 42, the integration result of the number of vehicles from the last time when the vehicle on which the on-board device of Company B is mounted has passed to the time when the vehicle C2 has passed, and the recognition result of the vehicle C2 input from the vehicle recognition unit 2.

The reset means 42 outputs the integration result of the number of vehicles from the last time when the vehicle on which the on-board device of Company B is mounted has passed to the time when the vehicle C2 has passed, and the recognition result of the vehicles input from the vehicle recognition unit 2 while the number of vehicles is integrated, to the vehicle C2 via the information notification unit 5, and instructs the vehicle number integration means 41 to reset the integration result of the number of vehicles in the vehicle information desired by Company B.

When the vehicle C2 enters the range where the vehicle C2 can communicate with a DB 9 of Company B, the vehicle C2 outputs, to the DB 7 of Company B, the integration result of the number of vehicles acquired from the vehicle information acquisition apparatus 1 from the last time when the vehicle on which the on-board device of Company B is mounted has passed to the time when the vehicle C2 has passed, and the recognition result of the vehicles input from the vehicle recognition unit 2 while the number of vehicles is integrated. That is, the vehicle on which the on-board device of Company B is mounted and the DB 9 of Company B constitute a vehicle system of Company B. The vehicle information acquisition apparatus 1 and the DB 9 of Company B constitute a vehicle information acquisition system.

At this time, if the authentication time, the passage time, and the traveling speed of each vehicle from when the vehicle on which the on-board device of Company B is mounted has passed to the time when the vehicle C2 has passed are stored in the data storage unit 6, the vehicle information acquisition apparatus 1 may output the authentication time, the passage time, and the travelling speed of the vehicles to the vehicle C2 via the information notification unit 5, and may output the authentication time, the passage time, and the traveling speed of the vehicles to the DB 9 of Company B via the vehicle C2.

The vehicle number integration means 41 starts integrating the number of vehicles in the vehicle information desired by Company B after the reset based on the recognition result of the vehicles input from the vehicle recognition unit 2, and continues to integrate the number of vehicles after the vehicle C1 desired by Company A has passed. At this time, the reset means 42 acquires a recognition result that the vehicle C2 is a small vehicle, which is a recognition result of the vehicle after the vehicle C1 has passed.

After that, the vehicle authentication unit 3 executes the vehicle authentication on the vehicles C3 and C4 entering the preset range based on the vehicle authentication information set by the vehicle registration means 31. However, since on-board device is not mounted on the vehicles C3 and C4, there is no response from the vehicles C3 and C4. Thus, the vehicle authentication unit 3 can recognize that the vehicles C3 and C4 are not the vehicle on which the on-board device of Company A is mounted or the vehicle on which the on-board device of Company B is mounted.

The vehicle number integration means 41 continues to integrate the number of vehicles after the vehicle C1 desired by Company A has passed, and continues to integrate the number of vehicles after the vehicle C2 desired by Company B has passed, based on the recognition result of the vehicles input from the vehicle recognition unit 2. The vehicle number integration means 41 recognizes the types of the vehicles C3 and C4 based on the recognition result of the vehicles input from the vehicle recognition unit 2, and outputs the recognition result of the vehicles C3 and C4 to the reset means 42.

Thus, the reset means 42 can acquire the recognition result that the vehicles C2 and C4 are small vehicles and the vehicle C3 is a large vehicle, which is the recognition result of the vehicles after the vehicle C1 has passed.

Figure 2C:
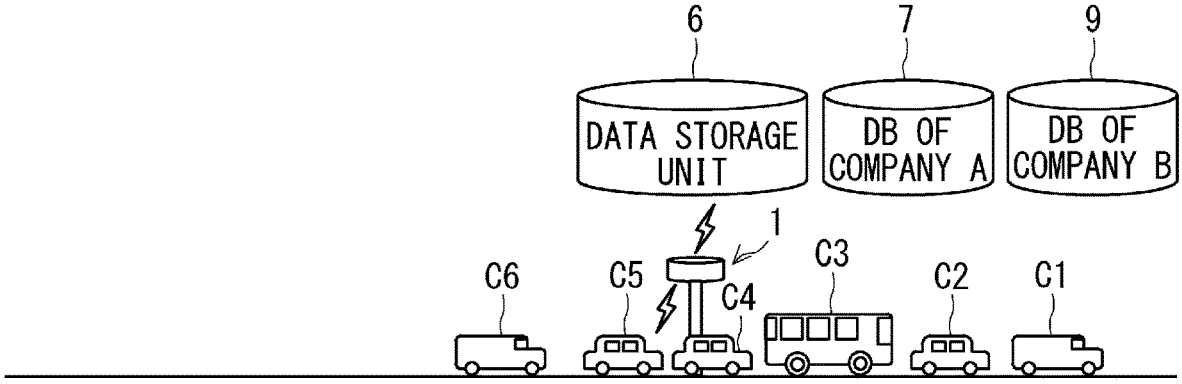
FIG. 2C shows a state in which vehicle information acquired by the vehicle information acquisition apparatus according to the embodiment is output to a database via a vehicle.

Next, as shown in FIG. 2C, the vehicle authentication unit 3 executes the vehicle authentication on the vehicle C5 entering the preset range based on the vehicle authentication information set by the vehicle registration means 31.

Since the on-board device of Company B is mounted on the vehicle C5, the vehicle C5 responds to a request for vehicle authentication from the vehicle authentication unit 3 of the vehicle information acquisition apparatus 1. Then, the vehicle authentication unit 3 which has received the response from the vehicle C5 recognizes that the vehicle authentication has been successful and outputs the authentication result to the integration unit 4 and the information notification unit 5.

When the authentication result is input to the integration unit 4, the vehicle number integration means 41 outputs, to the reset means 42, the integration result of the number of vehicles (3 vehicles) from when the vehicle C2 has passed to the time when the vehicle C5 has passed, and the recognition result of the vehicle C5 input from the vehicle recognition unit 2.

The reset means 42 outputs the integration result of the number of vehicles from the time when the vehicle C2 has passed to the time when the vehicle C5 has passed, and the recognition result of the vehicles input from the vehicle recognition unit 2 while the number of vehicles is integrated, to the vehicle C5 via the information notification unit 5, and instructs the vehicle number integration means 41 to reset the integration result of the number of vehicles in the vehicle information desired by Company B.

When the vehicle C5 enters the range where the vehicle C5 can communicate with the DB 9 of Company B, the vehicle C5 outputs, to the DB 9 of Company B, the integration result of the number of vehicles from the last time when the vehicle C2 has passed to the time when the vehicle C5 has passed, which is acquired from the vehicle information acquisition apparatus 1, and the recognition result of the vehicles input from the vehicle recognition unit 2 while the number of vehicles is integrated.

At this time, if the authentication time, the passage time, and the traveling speed of each vehicle from when the vehicle C2 has passed to the time when the vehicle C5 has passed are stored in the data storage unit 6, the vehicle information acquisition apparatus 1 may output the authentication time, the passage time, and the travelling speed of the vehicles to the vehicle C5 via the information notification unit 5, and may output the authentication time, the passage time, and the traveling speed of the vehicles to the DB of Company B via the vehicle C5.

The vehicle number integration means 41 starts integrating the number of vehicles in the vehicle information desired by Company B after the reset based on the recognition result of the vehicles input from the vehicle recognition unit 2, and continues to integrate the number of vehicles in the vehicle information after the vehicle C1 desired by Company A has passed.

At this time, the reset means 42 acquires a recognition result that the vehicles C2, C4, and C5 are small vehicles and the vehicle C3 is a large vehicle, which is a recognition result of the vehicles after the vehicle C1 has passed.

Figure 2D:
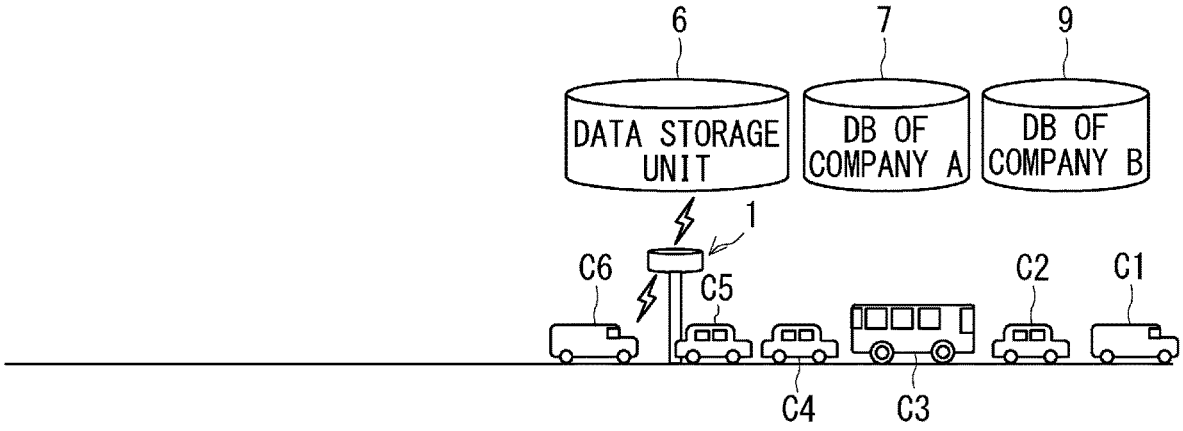
FIG. 2D shows a state in which vehicle information acquired by the vehicle information acquisition apparatus according to the embodiment is output to a database via a vehicle.

Next, as shown in FIG. 2D, the vehicle authentication unit 3 executes the vehicle authentication on the vehicle C6 entering the preset range based on the vehicle authentication information set by the vehicle registration means 31.

Since the on-board device of Company A is mounted on the vehicle C6, the vehicle C6 responds to a request for vehicle authentication from the vehicle authentication unit 3 of the vehicle information acquisition apparatus 1. Then, the vehicle authentication unit 3 which has received the response from the vehicle C6 recognizes that the vehicle authentication has been successful and outputs the authentication result to the integration unit 4 and the information notification unit 5.

When the authentication result is input to the integration unit 4, the vehicle number integration means 41 outputs, to the reset means 42, the integration result of the number of vehicles (5 vehicles) from when the vehicle C1 has passed to the time when the vehicle C6 has passed and the recognition result of the vehicle C6 input from the vehicle recognition unit 2.

The reset means 42 outputs the integration result of the number of vehicles from the time when the vehicle C1 has passed to the time when the vehicle C6 has passed, and the recognition result of the vehicles input from the vehicle recognition unit 2 while the number of vehicles is integrated, to the vehicle C6 via the information notification unit 5, and instructs the vehicle number integration means 41 to reset the integration result of the number of vehicles in the vehicle information desired by Company A.

When the vehicle C6 enters the range where the vehicle C6 can communicate with the DB 7 of Company A, the vehicle C6 outputs, to the DB 7 of Company A, the integration result of the number of vehicles from the last time when the vehicle C1 has passed to the time when the vehicle C6 has passed, which is acquired from the vehicle information acquisition apparatus 1, and the recognition result of the vehicles input from the vehicle recognition unit 2 while the number of vehicles is integrated.

At this time, if the authentication time, the passage time, and the traveling speed of each vehicle from when the vehicle C1 has passed to the time when the vehicle C6 has passed are stored in the data storage unit 6, the vehicle information acquisition apparatus 1 may output the authentication time, the passage time, and the travelling speed of the vehicles to the vehicle C6 via the information notification unit 5, and may output the authentication time, the passage time, and the traveling speed of the vehicles to the DB 7 of Company A via the vehicle C6.

The vehicle number integration means 41 starts integrating the number of vehicles in the vehicle information desired by Company A after the reset based on the recognition result of the vehicles input from the vehicle recognition unit 2, and continues to integrate the number of vehicles in the vehicle information after the vehicle C5 desired by Company B has passed.

At this time, the reset means 42 acquires a recognition result that the vehicle C6 is a medium vehicle, which is a recognition result of the vehicles after the vehicle C5 has passed. Note that the reset means 42 may acquire at least the recognition result of the vehicles being integrated.

By repeating the above steps, the vehicle information acquisition apparatus 1 can provide the vehicle information desired by Company A to the vehicle system 8 of Company A via the vehicle on which the on-board device of Company A is mounted, and can provide the vehicle information desired by Company B to the vehicle system of Company B via the vehicle on which the on-board device of Company B is mounted.

As described above, according to the vehicle information acquisition apparatus 1, the vehicle information acquisition system, and the vehicle information acquisition method according to this embodiment, for example, the vehicle on which the on-board device of Company A is mounted can acquire the number of vehicles from the time when the vehicle on which the on-board device of Company A is mounted has passed to the time when another vehicle on which the on-board device of Company A is mounted has passed.

Thus, in the vehicle information acquisition apparatus 1, the vehicle information acquisition system, and the vehicle information acquisition method, a vehicle on which a predetermined on-board device is mounted can acquire information including a vehicle on which this on-board device is not mounted. Thus, for example, Company A can accurately estimate the sales share of Company A.

In addition, when the vehicle information acquisition apparatus 1, the vehicle information acquisition system, and the vehicle information acquisition method according to this embodiment are used, for example, Company A can acquire the authentication time, the passage time, and the traveling speed in addition to the recognition result of the vehicles, which is effective in acquiring the traffic flow.

In the vehicle information acquisition apparatus 1, the vehicle information acquisition system, and the vehicle information acquisition method, for example, the recognition result of the vehicles or the like may be processed so that the vehicle information desired by Company A does not include information identifying other companies, for example, in a state where the vehicles cannot be linked to the other companies or in a state where the other companies cannot be identified.

Figure 4:
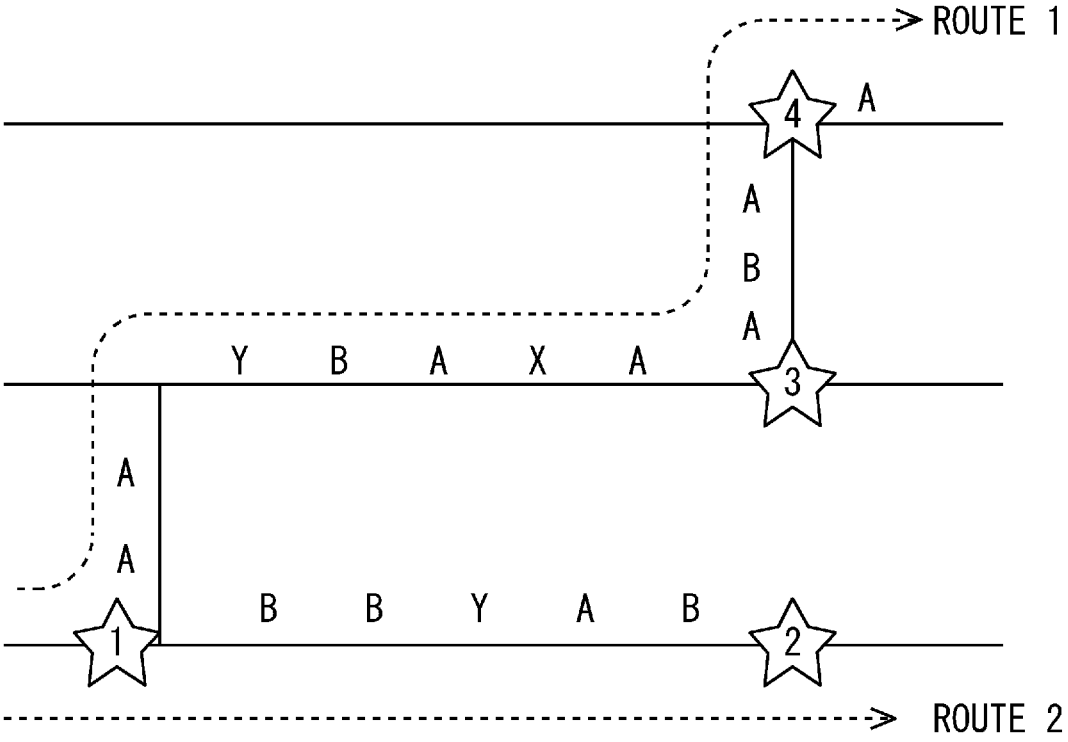
FIG. 4 is a diagram for explaining a comparison between a case where the vehicle information is acquired using the vehicle information acquisition apparatus according to the embodiment and a case where vehicle information is acquired using only the vehicle system.

Next, a comparison between a case where the vehicle information is acquired using the vehicle information acquisition apparatus 1 according to this embodiment and a case where the vehicle information is acquired using only the vehicle system will be described. FIG. 4 is a diagram for explaining a comparison between a case where vehicle information is acquired by using the vehicle information acquisition apparatus according to this embodiment and a case where vehicle information is acquired only using only the vehicle system.

In FIG. 4, the sign A denotes a vehicle on which the on-board device of Company A is mounted, the sign B denotes a vehicle on which the on-board device of Company B is mounted, and the signs X and Y denote vehicles on which the on-board device is not mounted. The stars indicate positions where the vehicle information acquisition apparatuses 1 are installed. Note that the route 1 is a route passing through the positions 1→3→4 where the vehicle information acquisition apparatuses 1 are installed, and the route 2 is a route passing through the positions 1→2 where the vehicle information acquisition apparatuses 1 are installed.

The number of vehicles passing the route 1 is six vehicles on which the on-board device of Company A is mounted, two vehicles on which the on-board device of Company B is mounted, and two vehicles on which no on-board device is mounted. At this time, since the information that can be obtained only by the vehicle system of Company B is for two vehicles, the accuracy of acquiring the traffic flow of the route 1 by Company B is low.

Likewise, the number of vehicles passing the route 2 is one vehicle on which the on-board device of Company A is mounted, three vehicles on which the on-board device of Company B is mounted, and one vehicles on which no on-board device is mounted. At this time, since the information that can be obtained only by the vehicle system of Company A is for one vehicle, the accuracy of acquiring the traffic flow of the route 2 by Company A is low.

On the other hand, when the vehicle information acquisition apparatuses 1 are installed at the star-marked positions of the route 1 and the route 2, the vehicle system of Company A and the vehicle system of Company B can acquire not only the vehicle information about the vehicles on which the on-board devices made by the respective Companies A and B are mounted, but also the vehicle information including the vehicle on which the on-board devices other companies are mounted via the vehicle information acquisition apparatuses 1. Thus, the traffic flow can be accurately acquired without depending on the company's sales share in the routes.

When the vehicle information acquisition apparatuses 1 are configured to be able to communicate with each other, the vehicle system of Company A and the vehicle system of Company B can acquire not only the vehicle information on the route 1 but also the vehicle information on the route 2 via the vehicle information acquisition apparatuses 1. Further, by installing the vehicle information acquisition apparatus 1 at an appropriate position, the company's sales share can be acquired for each area.

The present disclosure is not limited to the embodiment described above, and may be modified as appropriate without departing from the spirit of the disclosure.

For example, in the above embodiment, the number of vehicles from the time when the vehicle on which the on-board device of Company A is mounted has passed to the next time when the vehicle on which the on-board device of Company A is mounted has passed may be integrated. Alternatively, the number of vehicles may be integrated in units of time (e.g., 24 hours), or the number of vehicles from when the vehicle on which the on-board device of Company A is mounted has passed after a plurality of vehicles on which the on-board device of Company A is mounted have passed may be integrated.

For example, in the above embodiment, although the vehicle authentication is executed on each vehicle on which the on-board device made by each company is mounted, the category for executing the vehicle authentication is not limited to this. For example, the self-driving vehicle may be added to the category for executing the vehicle authentication. By doing so, it is possible to study the influence of the self-driving vehicles on the traffic flow on the road where both the general vehicles and the self-driving vehicles are present.

For example, the vehicle recognition unit 2 and the vehicle authentication unit 3 may be fixed to a road or may be portable and installed on a road.

For example, the vehicle information acquisition apparatus 1 according to the above embodiment outputs the integration result of the number of vehicles and the recognition result. However, at least the integration result of the number of vehicles may be output to the vehicle.

For example, in the above embodiment, the present disclosure has been described as a hardware configuration, but the present disclosure is not limited to this. The present disclosure can also achieve specified processing by causing a CPU (Central Processing Unit) to execute a computer program.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A vehicle information acquisition apparatus comprising:

a processor programmed to:

execute vehicle authentication on a vehicle entering a preset range based on preset vehicle authentication information; and integrate the number of vehicles passing after the vehicle passes when the vehicle authentication executed on the vehicle is successful; and notify, when the vehicle authentication executed on another vehicle passing after the vehicle passes is successful, the other vehicle of the number of vehicles integrated.

2. The vehicle information acquisition apparatus according to claim 1, wherein the processor is programmed to:

acquire an image of the vehicle entering the preset range, and recognize the vehicle entering the preset range based on the acquired image;

integrate the number of vehicles entering the preset range based on a result of the recognition of the vehicle; and reset the integration of the number of vehicles when the vehicle authentication on the other vehicle is successful.

3. The vehicle information acquisition apparatus according to claim 1, wherein the processor is programmed to:

set the preset vehicle authentication information; and execute the vehicle authentication on the vehicle entering the preset range based on the preset vehicle authentication information.

4. A vehicle information acquisition system comprising:

the vehicle information acquisition apparatus according to claim 1; and a database, wherein when the vehicle notified of the number of vehicles integrated enters a communicable range, the database receives input from the vehicle of the number of vehicles integrated.

5. The vehicle information acquisition system according to claim 4, wherein a plurality of the vehicle information acquisition apparatuses are installed in a mutually communicable manner.

6. A vehicle information acquisition method comprising:

executing vehicle authentication on a vehicle entering a preset range based on preset vehicle authentication information;

integrating the number of vehicles passing after the vehicle passes when the vehicle authentication executed on the vehicle is successful; and notifying, when the vehicle authentication executed on another vehicle passing after the vehicle passes is successful, the other vehicle of the integrated number of vehicles.

7. The vehicle information acquisition method according to claim 6, further comprising:

acquiring an image of the vehicle entering the preset range, and recognizing the vehicle entering the preset range based on the acquired image; and notifying the other vehicle which is successfully authenticated of a result of the recognition of the vehicle entering the preset range while the number of vehicles is integrated.

8. The vehicle information acquisition method according to claim 6, further comprising:

acquiring an image of the vehicle entering the preset range, and acquiring a passage time or a traveling speed of the vehicle based on the acquired image; and notifying the other vehicle which is successfully authenticated of the passage time or the traveling speed of the vehicle entering the preset range while the number of vehicles is integrated.

9. The vehicle information acquisition method according to claim 6, further comprising:

acquiring an authentication time at which the vehicle authentication is executed on the vehicle entering the preset range; and notifying the other vehicle which is successfully authenticated of the authentication time of the vehicle entering the preset range while the number of vehicles is integrated.

10. A non-transitory computer readable medium storing a vehicle information acquisition program for causing a computer to execute:

a process of executing vehicle authentication on a vehicle entering a preset range based on preset vehicle authentication information;

a process of integrating the number of vehicles passing after the vehicle passes when the vehicle authentication executed on the vehicle is successful; and a process of notifying, when the vehicle authentication executed on another vehicle passing after the vehicle passes is successful, the other vehicle of the integrated number of vehicles.

* * * * *